US008356803B2

(12) United States Patent
Truckner

(10) Patent No.: US 8,356,803 B2
(45) Date of Patent: Jan. 22, 2013

(54) ATTACHMENT FOR BALUSTER FOR STAIR, BALCONY OR LANDING RAILS FOR BOTH ADJUSTABLE AND FIXED RAILINGS

(75) Inventor: Richard P. Truckner, Pasadena, CA (US)

(73) Assignee: Quick Baluster Installation LLC, Flower Mound, TX (US)

( * ) Notice: Subject to any disclaimer, the term of this patent is extended or adjusted under 35 U.S.C. 154(b) by 1142 days.

(21) Appl. No.: 12/151,929

(22) Filed: May 9, 2008

(65) Prior Publication Data

US 2009/0278106 A1 Nov. 12, 2009

(51) Int. Cl.
*E04H 17/14* (2006.01)

(52) U.S. Cl. ..... 256/67; 256/DIG. 2

(58) Field of Classification Search ..... 256/67, 256/DIG. 2

See application file for complete search history.

(56) References Cited

U.S. PATENT DOCUMENTS 1,663,203 A * 3/1928 Luipersbek ..... 256/67
4,505,456 A * 3/1985 Zieg ..... 256/67
5,584,469 A * 12/1996 Goodwin ..... 256/67
5,695,175 A * 12/1997 Hawkins ..... 256/67
6,279,880 B1 * 8/2001 Hawks, Jr. ..... 256/67
6,932,329 B1 * 8/2005 Harder ..... 256/67
7,438,282 B1 * 10/2008 Harder ..... 256/67
7,441,750 B1 * 10/2008 Harder ..... 256/67
7,748,686 B1 * 7/2010 Harder ..... 256/67
7,762,533 B2 * 7/2010 DeRogatis et al. ..... 256/67
2007/0246698 A1 * 10/2007 Truckner et al. ..... 256/67

* cited by examiner

*Primary Examiner* — Victor MacArthur
(74) *Attorney, Agent, or Firm* — Welsh Flaxman & Gitler LLC

(57) ABSTRACT

A method and apparatus for attaching balusters for a stair, balcony, deck, landing or the like providing an adjustable connection of a baluster to a rail and a base surface. The apparatus includes a ball adapter and a socket. The ball adapter is joined with the socket and mounted on a stair surface. The ball adapter and its mounting to the socket provides for limited adjustable movement of the adapter with respect to the socket and the stair surface. The ball adapter provides for the attachment of a baluster to the adapter. The adjustable connection of this apparatus can be used to attach to a rail or to a base of a stair, balcony, deck, landing or the like. The ball adapter and socket can be used to produce modular prefabricated baluster systems that can be adjusted for any slope or level rail and baluster installation.

6 Claims, 9 Drawing Sheets

ATTACHMENT FOR BALUSTER FOR STAIR, BALCONY OR LANDING RAILS FOR BOTH ADJUSTABLE AND FIXED RAILINGS

STATEMENT REGARDING FEDERALLY-SPONSORED RESEARCH OR DEVELOPMENT

Not applicable

REFERENCE TO MICROFICHE APPENDIX

Not applicable

BACKGROUND OF THE INVENTION

This invention relates to construction of railing systems associated with stairs, balcony, landing or deck railings and particularly to the construction and attachment of balusters to such constructions.

In the construction of stairs, decks, balconies and the like, there is a need for installing railings and balusters between the railings and the base of the stair, balcony, landing or deck and there are frequent jurisdictional codes as to the size and spacing of balusters along such railings. The construction of railings and the installation of balusters with those railings at a job site can be time consuming in the spacing and attachment of the balusters between the railing and a base. The present invention is intended to provide a simplified apparatus for positioning and adjusting balusters along a railing installation.

The on site installation of balusters to a sloping stairway requires measurement and alignment of separate balusters to conform to the slope of the stairway. Because not all stairways are of the same slope, the installing of a baluster may require drilling mounting holes in a railing for connection of a baluster and aligning such holes with mounting holes along a base surface. The present invention provides a simplified means and method for installing balusters along a railing regardless of the slope of a stairway or the spacing between the railing and a base surface.

SUMMARY OF THE PRESENT INVENTION

In accord with the present invention baluster attachment to stair or balcony railing is accomplished using a ball joint attachment. The ball joint can be used to attach a baluster between rails using a ball joint top and bottom (both ends) of the baluster or attaching the baluster to a top rail only and using a base to attach the baluster to a tread at the bottom. The ball joint may be adjustable in a longitudinal direction only along the length of the rail by pinning the ball joint at 90° to the axis of the rail to form a modular configuration of multiple balusters held by fillet rails of various lengths which can be attached to a rail or (without a plough) accommodated in a rail plough at top and bottom to form an adjustable rail which is variable in length according to the number of modules which are held between the rails. In this configuration the balusters are attached to the fillet rails and the fillet rails are attached to the top and bottom rails—also known as the banister rail and shoe rail. The baluster may also e attached to the top rail using a ball adapter. A socket is used to conform the surface of the rail in multi planar attachment or a hole is drilled to form a socket also allowing a multi planar attachment to the rail. A screw may be used to attach the ball adapter which may be a separate screw or a permanently fixed screw The screw is used to hold the socket in place or in the case of a socket hole it is used to hold the ball in the hole.

The base which is used to attach the bottom of the baluster to a tread may be attached to the tread via base thread or screw. As a part of the baluster attachment to a fillet rail, a clip can also be used as an alternative to drilling pin holes in the fillet rails. The clips are a variation of a socket and the clip socket is independently attached to form a movable socket hole.

OBJECTS OF THE PRESENT INVENTION

It is an object of the present invention to provide a simplified apparatus and method for attaching balusters between a railing and a base surface of a deck, tread, balcony, landing or the like by providing an attachment assembly that permits the installation of a baluster regardless of the angular slope between the railing and a base.

A further object in accord with the preceding object is the provision of an assembly of a ball adapter and a socket that permits the movable adjustment of the angle of a baluster with respect to the slope of a rail to provide for ease of installation of the baluster to the rail and/or a base.

A further object in accord with the preceding objects is to provide for the assembly of a plurality of balusters with a railing insert that will permit the installation of adjustable modules of balusters along spaces in a stair, deck, balcony, or landing.

Further objects and features of the present invention will be readily apparent to those skilled in the art in view of the following specification and drawings.

DETAILED DESCRIPTION OF THE INVENTION

Throughout the following description, specific details are set forth in order to provide a more thorough understanding of the invention; however, the invention may be practiced without these particulars. In other instances, well known elements have not been shown or described to avoid unnecessarily obscuring the invention. Accordingly, the specification and drawings are to be regarded in an illustrative, rather that a restrictive, sense.

Figure 1:
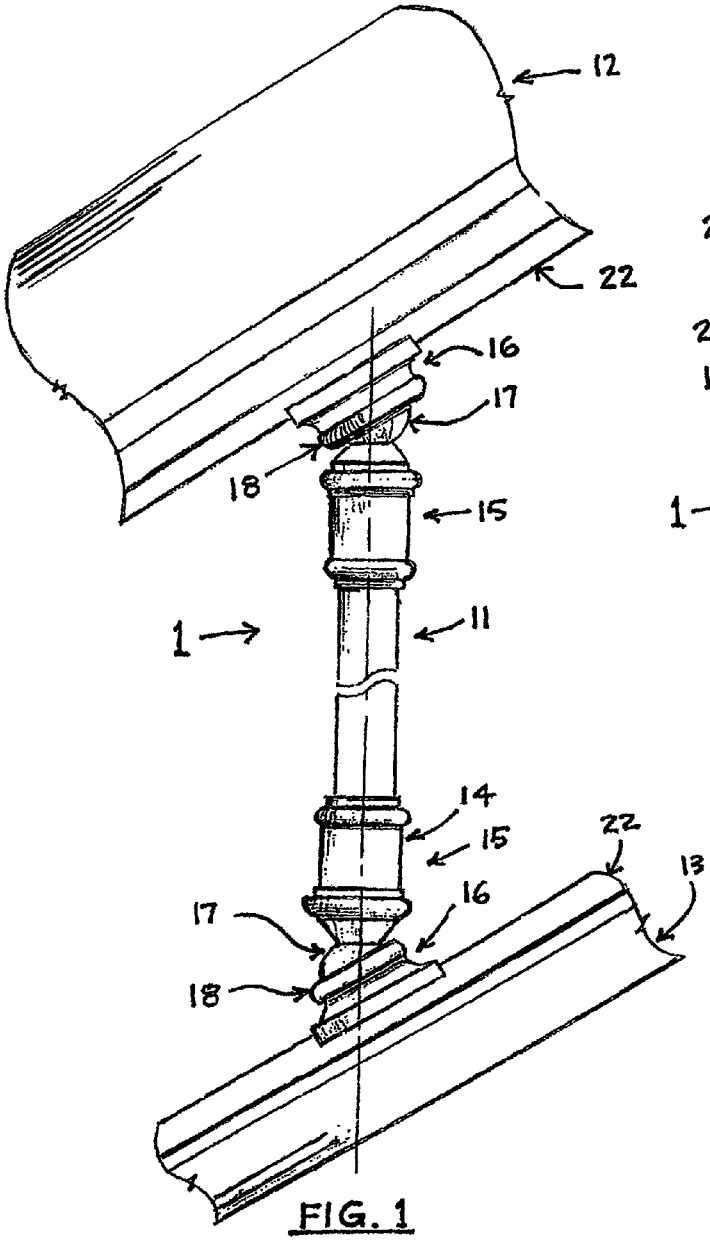
FIG. 1 is a front elevation view of a baluster installed between a rail and a base showing the elements of the present invention.

FIG. 1 illustrates an assembly 1 of a baluster installation wherein a baluster 11 is shown attached between a top rail 12 and a bottom rail or shoe rail 13 using a ball and socket connector 14 at the top and bottom of the baluster. The connection to the rails includes a ball adapter 15 and a socket 16. The connector 14 assembly is more fully described hereinafter along with its function of providing an adjustable connection of a baluster to a rail, balcony, landing or tread in a stair.

Figure 2:
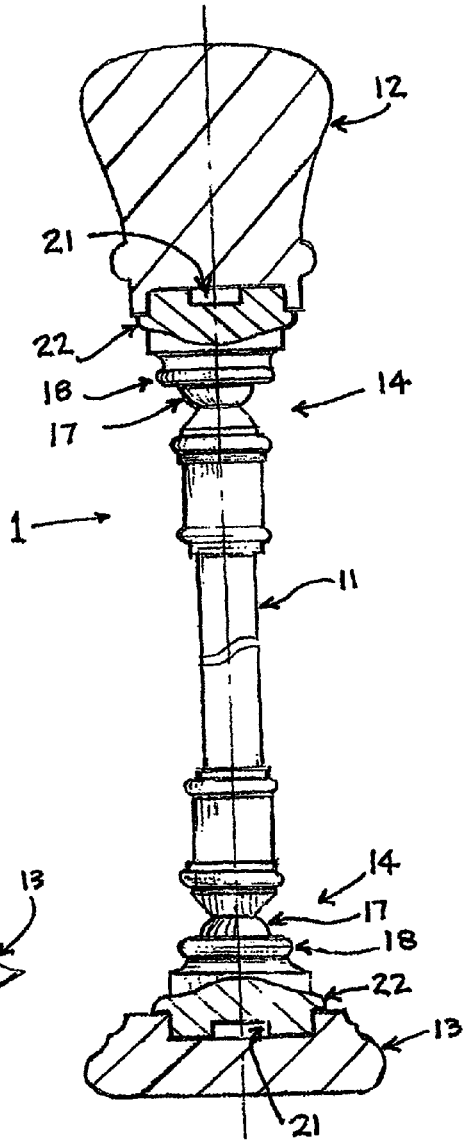
FIG. 2 is a partial section view of the baluster installation of FIG. 1.

FIG. 2 illustrates, in partial section, the installation of a baluster 11 connection to a top rail 12 having a plough 21 in its lower surface and a fillet rail 22 in the plough and the ball and socket connector 14 attached to the under surface of the plough 22. This sectional view shows the plough and fillet rail at both the top and the bottom of the baluster installation.

The installation of a baluster to a rail system as shown in FIGS. 1 & 2 illustrates the ability of the baluster 11 to be installed in a rail system regardless of the slope of the railing in the ball and socket connector assembly provides for a ball surface 17 to be rotatable within a socket cup 18 of the socket 16 at both ends of the installation.

Figure 3:
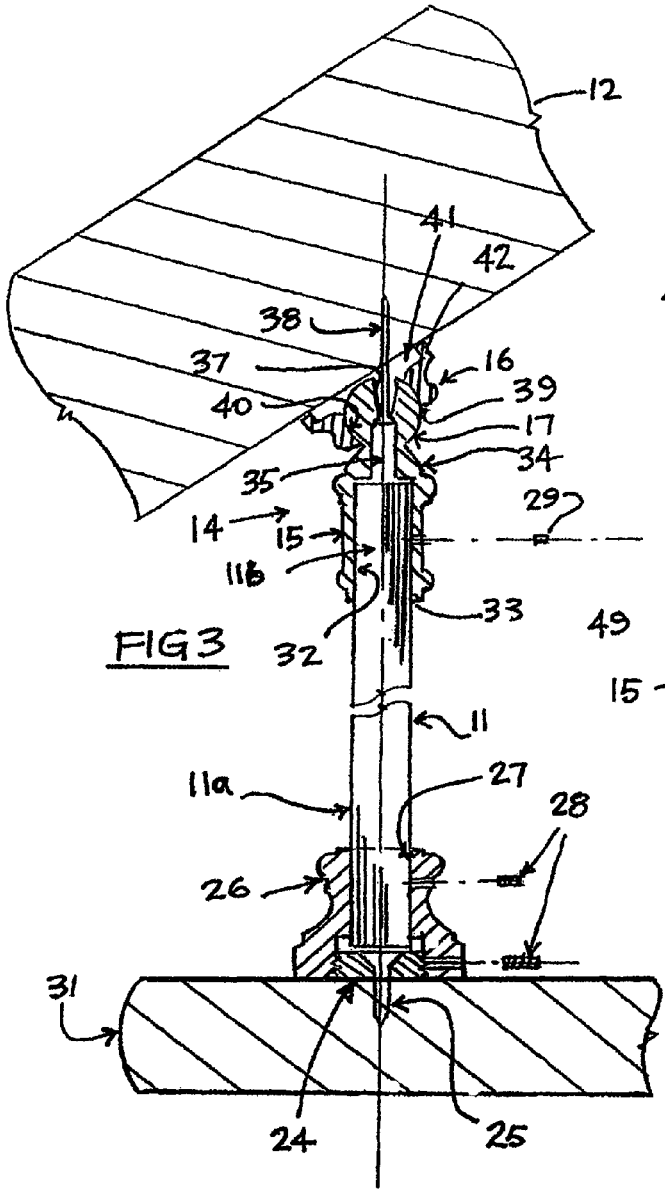
FIG. 3 is another partial section view showing several elements of the present invention.

FIG. 3 illustrates the assembly of a connector 14 wherein a baluster 11 is connected to a sloping top or upper rail 12 and a horizontal base or tread 31. In this figure, the ball adapter 15 includes a ball 17 and an interior cavity 32 open at its bottom end 33 and terminating at it upper end 34 below the ball surface 17. The ball adapter 15 further includes an interior passageway 35 of lesser diameter than the cavity 32 and extending from the upper end 34 of cavity 32 to the center axis of the ball 17 at a shoulder 36 in that passageway 35. The ball 17 then has an extending cavity 37 of pyramidal form (to be described hereinafter) for accommodation of a screw attachment means 38.

The ball 17 engages the socket 16 at an opening 39 having a complementary form for engaging the ball and the interior 40 of the opening 39 is tapered to engage the exterior of the ball 17 and to provide a movable connection between the socket 16 and the ball adapter 15. The socket then has an open end at 41 terminating in a perimeter shoulder 42. The screw attachment means 38 then passes through the internal cavity 32, the further passageway 35 and the pyramidal cavity 37 and can be driven into the underside of a rail 12 to secure the socket 16 to the rail 12 and to engage the ball 17 within the socket. The location of the head of the screw 38 at the intersection of the pyramidal cavity 37 and the cavity 35 permits the ball adapter 15 to be movable side-to-side in two directions of movement with respect to the rail and within the socket cup opening 39.

FIG. 3 also shows another attachment of the baluster 11 to a base or tread 31 wherein a base washer or adapter 24 is secured to the base 31 by a screw 25. A base baluster connector 26 having a hollow interior 27 is adapted to receive the lower end 11*a* of a baluster 11. The connector 26 can be axially slidable along the baluster 11 and, as shown in this FIG to be attachable to the exterior of the end 11*a* of the baluster and to the base washer 24 by set screws 28. Also as shown in this FIG, the upper end 11*b* of the baluster 11 can be attached to the ball adapter by a set screw 29. The installation of a baluster to the form shown in FIG. 3 will be more fully described hereinafter.

Figure 4:
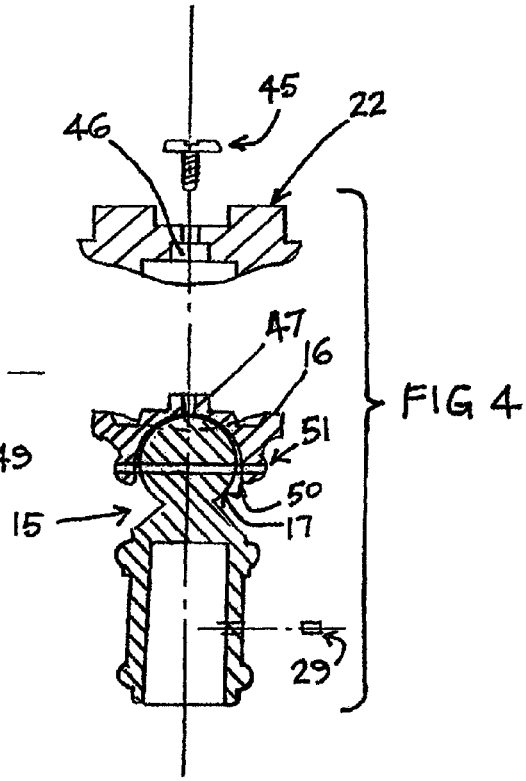
FIG. 4 is a section view of an alternative form of the present invention.

FIG. 4 illustrates an alternative form of cooperating assembly of a ball adapter and a socket, and is illustrated in an assembly used with a fillet rail. In this alternative form the socket 16 is attachable to a fillet rail 22 by a screw 45 passing through a hole 46 in the rail and into a threaded portion 47 in the socket 22. The interior of the base of the fillet rail 22 and the exterior of the socket 16 are formed with complementary surfaces to provide a smooth connection between the socket and the fillet rail. The interior 48 of the socket is formed to receive the ball 17 portion of the ball adapter 15. A transverse hole passes 49 through the peripheral edges of the portion of the socket 16 that accommodates the ball 17. The ball 17 includes a transverse hole 50 positioned so that it is aligned with the hole 49 in the socket and the two holes are designed to receive a mounting shaft 51, or pin, for supporting the ball adapter 15 in movable alignment within the socket 16. This movable alignment permits the ball adapter 15 to have limited rotational movement about an axis transverse to the fillet rail 22.

The assemblies shown in FIGS. 3 & 4 are adapted for mounting a baluster to the under surface of a rail or a fillet rail, and as will be described hereinafter, these assemblies could be use to connect a baluster to a base surface of a stair or the like.

Figure 5:
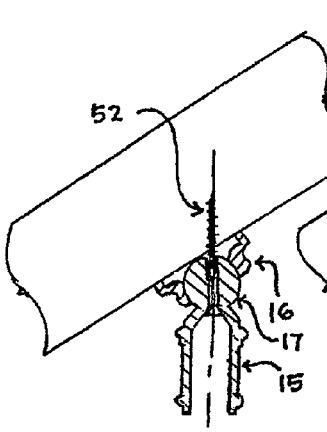
FIG. 5 is a partial section view showing elements of the present invention.

FIG. 5 illustrates another alternative form for the assembly of a ball adapter and socket and its means of mounting to a rail. In this form the ball adapter 15 has a ball surface 17 that cooperates with a socket 16 and a screw 52 passes axially through the center of the ball 17 to engage the under surface of the rail 12.

Figure 6:
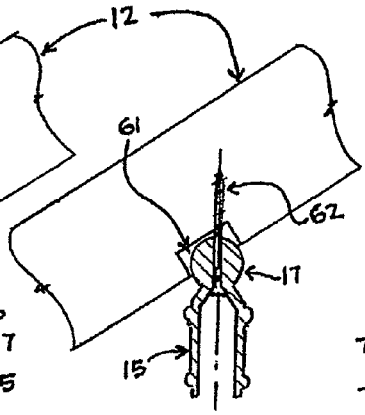
FIG. 6 is a partial section view of another form of the present invention.

FIG. 6 illustrates another alternative form of attaching a ball adapter 15 to the undersurface of a rail 12. In this form, a cutout 61 is cut into the under surface of the rail 12 and the ball 17 fits into that cutout 61. A screw 62 passes through the center of the ball 17 and is screwed into the surface of the rail 12 at the interior of the cutout 61.

Figure 7:
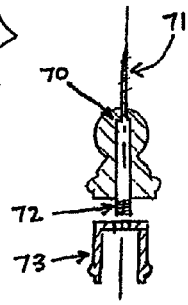
FIGS. 7 & 8 are additional alternative forms of the ball adapter.

FIG. 7 illustrates an alternative form for the ball adapter 15 wherein the ball 17 is fabricated with an attachment device 70 having screw end 71 extending out of the ball 17 for engagement with a rail and a threaded end 72 for attaching a cup like portion 73 adapted to receive an end of a baluster (not shown). A threaded cup or nut may be installed through the interior of the cup 73 to attach the cup to the ball 17 at the threaded end 72 of the device 70. When the elements of FIG. 7 are assembled to form a ball adapter 15, the assembly can be mounted to a rail in the manner described with respect to FIG. 5 or 6.

Figure 8:
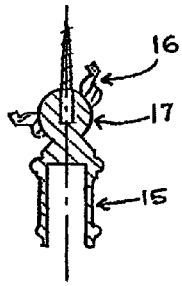

FIG. 8 illustrates another alternative form for construction of the ball adapter 15. In this form the ball 17 portion of the adapter is formed with an imbedded mounting means 80 with a screw threaded portion extending from the surface of the ball. As illustrated, this form of ball adapter many be mounted to the under surface of a rail in the manner shown in FIG. 5.

Figure 9:
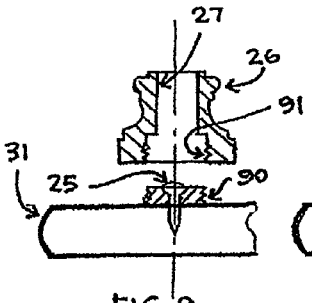
FIGS. 9 & 10 are forms of base attachment elements.

FIG. 9 illustrates a structure for attaching the bottom end of a baluster to a base surface of a stair, tread, balcony, landing or the like. In this form a washer-like element 90 having external threads is attached to a base 31 by screw 25 passing through the element 90 and into the base 31. A connector 26 has a hollow interior and an interior threaded portion 91 adapted to mate with the external threads of the element 90 to secure the connector 26 to the element 90 and base 31. This form of base connection is as described with respect to FIG. 3 where the hollow interior of the connector 26 is adapted to receive the end of a baluster and to make a solid connection to the base through the threaded connection with the washer-like element 91.

Figure 10:
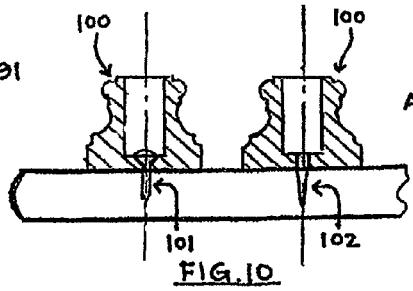

FIG. 10 illustrates two alternative forms for baluster connectors for the baluster attachment of the present invention. In these forms the connector 100 is a hollow form with either a screw 101 for passing through the interior of the connector to a base or the connector is formed with an imbedded screw 102.

Figure 11:
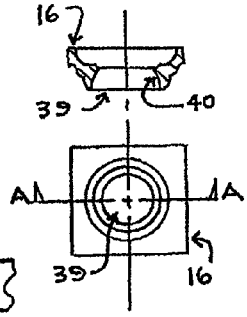
FIG. 11 is a plan and section view of socket construction

FIG. 11 is a plan and section view of a form of the socket 16 that is to be attached to the underside of a rail as with the ball adapter mounting systems shown in FIGS. 3 & 5. The opening 39 in the socket, as shown in the section taken along lines A-A of FIG. 11, has a tapered surface 40 (here shown as hemispherical) that mates with the exterior surface of the ball as shown in FIGS. 3 or 5.

Figure 12:
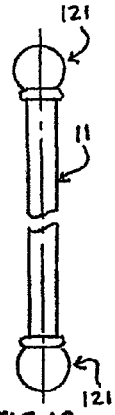
FIG. 12 is an elevation view of a baluster with ball structure at each end.

FIG. 12 is an illustration of a simple baluster having ball surfaces 121 at each end. These ball surfaces 121 an be adapted to cooperate with a socket 16 to be mounted to the under surface of a rail or the base of a stairway.

Figure 13:
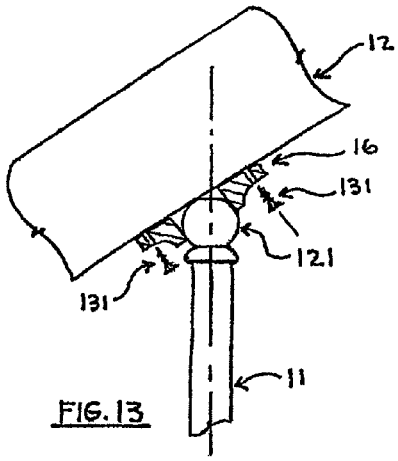
FIG. 13 is an illustration of the installation of a baluster like FIG. 12.

FIG. 13 illustrates the use of a baluster 11 in the form shown in FIG. 12 with ball surfaces 121 and a socket 16 attached to a rail 12 by screws 131, or the like, passing through a surface of the socket 16.

Figure 14:
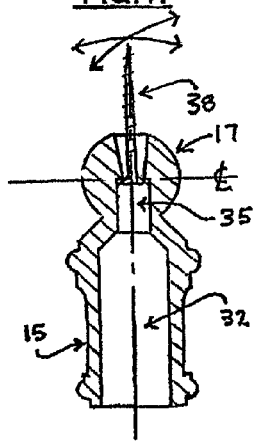
FIG. 14 is a cross-section view of a ball adapter of the present invention.

FIG. 14 is an illustration of the ball adapter 15 showing the interior cavity 31 and the further interior cavity 35 terminating at the center of the ball and adapted to cooperate with the head of a screw 38. Also illustrated is the pyramidal cavity that permits limited pivotal movement of the ball adapter 15 with respect to it mounting on a rail or the like. The perspective shown perpendicular arrows are intended to illustrate the moveable motion of the ball adapter and a baluster attached to it for assembling a baluster on a railing as will be described hereinafter.

Figure 15:
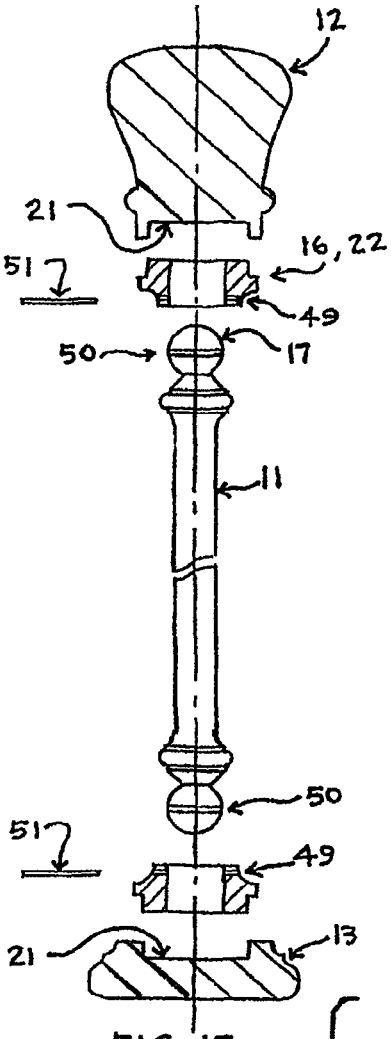
FIG. 15 is an exploded illustration of the parts of an assembly of the present invention for mounting a baluster to a banister and a shoe rail.
Figure 16:
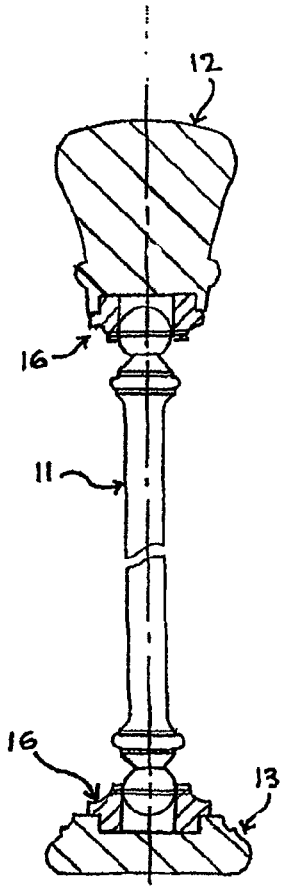
FIG. 16 is the apparatus of FIG. 15 in assembled form and installed.

FIG. 15 is an exploded illustration of the elements of an baluster construction for mounting on a rail system. FIG. 16 illustrates the elements of FIG. 15 when assembled. In FIG. 15, starting from the top, illustrates a rail 12 with a plough, a fillet rail 22 or socket 16 of the form shown in FIG. 4 with a pin 51 passing through a hole 49 in the socket and through a hole 50 in the ball for mounting a ball adapter 15 to the fillet rail 22 or socket 16, a baluster 11 having ball surfaces 121 at each end, and a base mounting assembly including a ball adapter, socket 16, pin 51 and aligned holes 49 and 50, and means for attaching the fillet rail 22 or socket 16 to a plough 21 in a shoe or bottom rail 13. FIG. 16 illustrates all of the parts of FIG. 15 in assembly.

Figure 17:
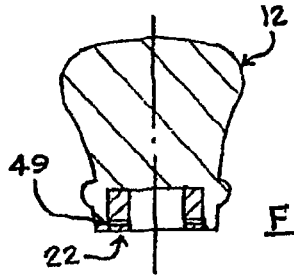
FIGS. 17, 18 & 19 are alternative forms of plough and fillet rails in a banister.
Figure 18:
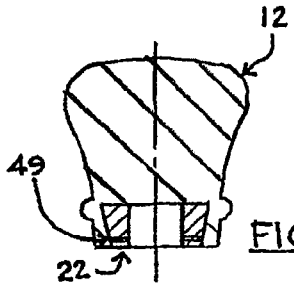
Figure 19:
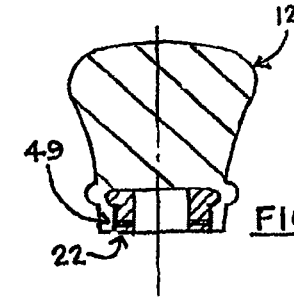

FIGS. 17, 18 & 19 illustrate alternative forms of ploughs 21 in a rail 12 and different means for maintaining a fillet rail 22 within the ploughs. FIG. 17 illustrates a form with the fillet rail having a flush mating with the rail plough. FIG. 18 illustrates a dovetail mating form for the plough and fillet rail. FIG. 19 illustrates a tongue and groove mating form for the plough and fillet rail. In each of these cases, the plough is a continuous groove formed in the surface of the rail from one end to the other end of the rail. The fillet rail is adapted to be inserted into the plough and is used in the formation of modular assemblies of balusters as will be described hereinafter.

Figure 20:
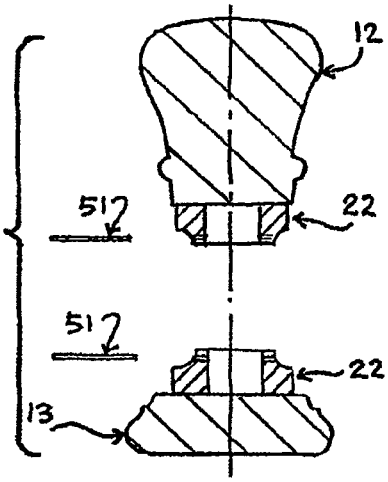
FIG. 20 is an exploded illustration of a banister and shoe rail with mounting sockets.

FIG. 20 illustrates a top rail 12 and a bottom rail 13 having an attached fillet rail 22 showing holes passing laterally through the fillet rail edges 23 for accommodating a pin 51 for mounting a baluster assembly.

Figure 21:
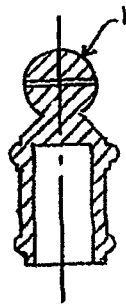
FIG. 21 is a section view of an alternative form of a ball adapter.

FIG. 21 illustrates a form of ball adapter for mounting the adapter in a socket 16 or a fillet rail 22 (shown in FIG. 15) using a pin 51 through the ball portion 17.

Figure 22:
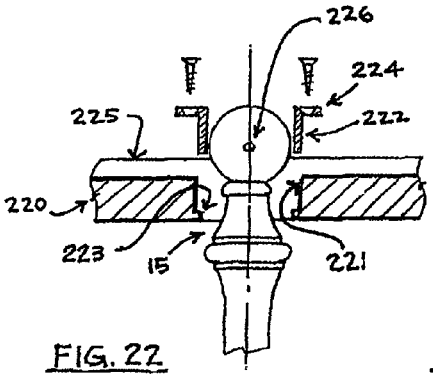
FIG. 22 is a section view showing the use of clip attachment for mounting a ball adapter to a fillet rail.
Figure 23:
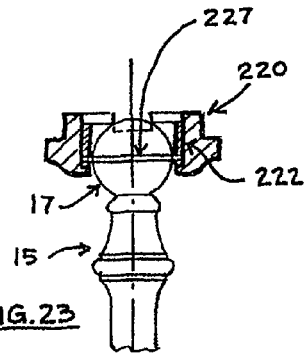
FIG. 23 is section view through FIG. 22 along lines 2-2.

FIGS. 22 through 31 illustrate an alternative form of attaching a ball adapter to a fillet rail system. In FIG. 22 a fillet rail 220 is illustrated with a cutout hole 221 extending vertically through the rail and adapted to receive a cup shaped clip 222. The cutout 221 has a diameter to receive the clip and reduced diameter end at 223 to cooperate with the exterior end of the clip 222 and to act as a stop for the insertion of the clip within the fillet rail. The reduced diameter end is larger that the diameter of a ball portion 17 of a ball adapter for reasons that will be apparent hereafter. The clip has diametrically opposed tabs 224 adapted for mounting the clip in the fillet rail 220 and the rail has a longitudinal groove 225 on its outer surface for cooperating with the tabs. The tabs 224 are adapted to receive screws for attaching the clip to the groove 225 in the rail 220. As shown in FIG. 22, a ball adapter 15 can be mounted in the clip 222 and the ball adapter 15 can be provided with as central hole 226 passing through the ball 17 at its center, the hole is shown in the ball of FIG. 22 at 90° to the axis of the fillet rail 220, for accommodating a pin 227 for supporting rotational movement of the ball adapter about the pin 227 (FIG. 23).

As illustrated in this FIG, the ball adapter 15 is inserted up through the reduced diameter hole 223 in the rail 220 and the clip 222 is placed on the ball 17 with pin 227 passing through the hole 226 in the ball and the holes 228 in the clip. Then the clip is passed down through the hole 223 and the tabs 224 are fixed with screws to the groove 225 in the surface of the fillet rail. When so assembled and extending from the outside of the rail 220, the ball adapter 15 is adapted to receive an end of a baluster.

FIG. 23 illustrates a sectional view through the apparatus as shown in FIG. 22 with the ball adapter 15 mounted in the clip 222 and the clip moved down into place in the rail. The ball 17 is pivoted about the pin 227 in the clip 222.

Figure 24:
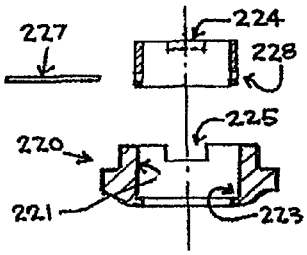
FIG. 24 is a section view of elements of a clip and fillet rail installation.

FIG. 24 is an exploded sectional view showing a cross-section of a fillet rail 220 with the transverse hole 221, the reduced diameter end 223, and the groove 225. Above the representation of the rail 220 is the clip 222 with its tab 224 and holes 228 for the pin 227. As illustrated, the clip 222 is intended to be inserted into the rail 220 after a ball adapter (not shown) has been mounted in the clip 222.

Figure 25:
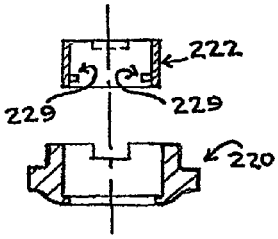
FIG. 25 is an alternative form of clip and fillet rail construction.

FIG. 25 illustrates an alternative form of the clip 222 wherein a pair of pins 229 are formed in the clip for mounting a ball adapter to the clip instead of the use of a pin passing through the clip 222 and the ball 17 of the ball adapter 15.

Figure 26:
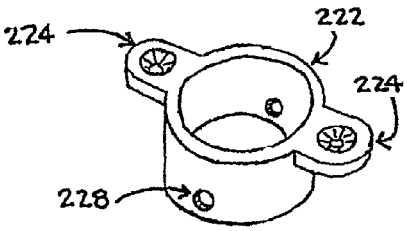
FIGS. 26 & 27 are alternative forms of clip construction.

FIG. 26 is a perspective view of the clip shown in FIG. 22. The clip of FIG. 26 is used as shown in FIGS. 22 and 23.

Figure 27:
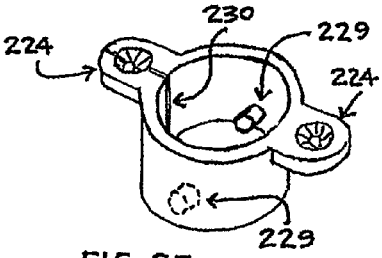
Figure 28:
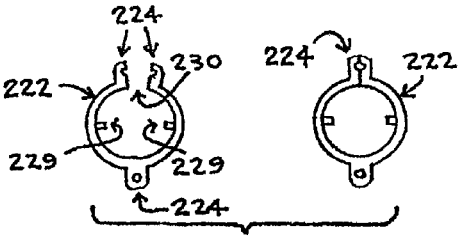
FIG. 28 illustrates the use of the clip of FIG. 27.

FIG. 27 is a perspective view of the alternative form of clip shown in FIG. 25 and illustrates the clip with a cut wall surface at 230 and the pins 229 molded into the interior surface of the clip. This form of clip would be opened at the cut wall as shown in the left side of FIG. 28 so as to permit the clip to be placed about the ball surface 15 of ball adapter (not shown) and then the pins 229 can be inserted in the hole through the ball 17 as shown in FIGS. 4 & 21. FIG. 28 illustrates a clip with a single cut wall 230 in the left side view and in the right side view the illustration is a clip 222 make in two halves for duplicating the form of clip shown in FIG. 26.

Figure 29:
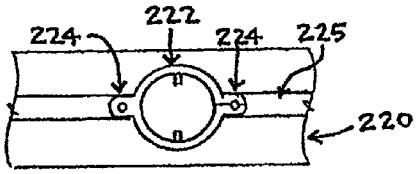
FIG. 29 is a top plan view of a fillet rail with a clip installation and showing the tabs in place in a groove in the fillet rail.
Figure 30:
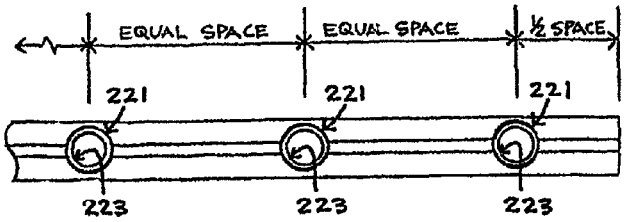
FIG. 30 is an illustration of a portion of a fillet rail in preparation for installation of clip fasteners or for ball adapter installations without a socket.

FIG. 29 illustrates a top plan view showing a clip 222 mounted with tabs 224 in the groove 225 of a fillet rail 220. FIG. 30 illustrates a portion of a rail 220 adapted with spaced cutout holes 221 and the reduced diameter portion 223. The spacing between cutout holes 221 may be as required by building codes for baluster spacing and, as illustrated at the right end of the illustration, and end of a fillet rail 220 may be one half of the distance between code spaced holes so that the ends of two fillet rails will provide for a full spacing between the first and last hole in adjacent fillet rails.

Figure 31:
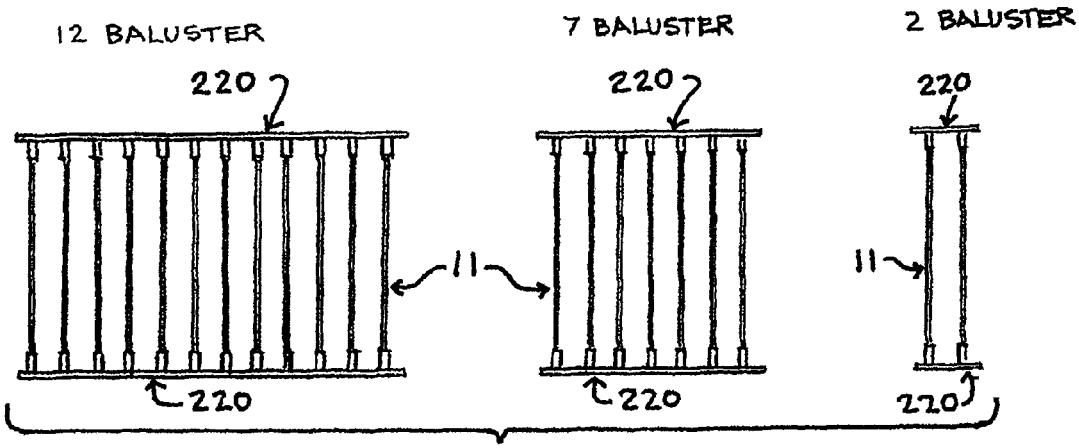
FIG. 31 is an illustration of adjustable baluster modules assembled in accord with the present invention.
Figure 32:
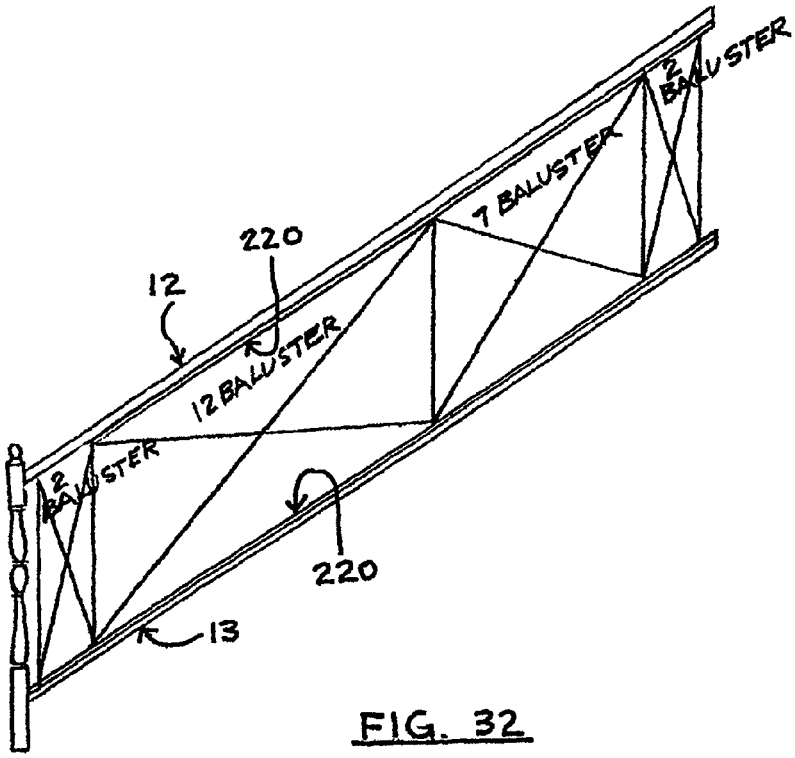
FIG. 32 is an elevation view showing baluster modules installed along a sloping stair or ramp.

FIG. 31 and FIG. 32 illustrate the possible assembly of modules of balusters for installation along a rail. In FIG. 31 three assemblies are shown; one at the left with 12 balusters, a central assembly having 7 balusters, and on the right an assembly with 2 balusters. With the apparatus and method of the present invention, these assemblies of modules of balusters can be preassembled with fillet rails before being delivered to a job site in units that will span the length of a desired rail system. On the job site, as shown in FIG. 32, the modules are then attached to rails having a plough adapted to receive the fillet rail. The modules are adjustable in slope to match any slope of a stair or ramp or the horizontal surface of a deck, balcony or landing. The modules can be mounted between posts on the job site. Modules for step cut railings having balusters of different length can also be prefabricated and sent to the job site. Also, with the flexible assembly of balusters to a top rail and a base rail, the ball adapter system of the present invention provides for ease of installation.

Figure 33:
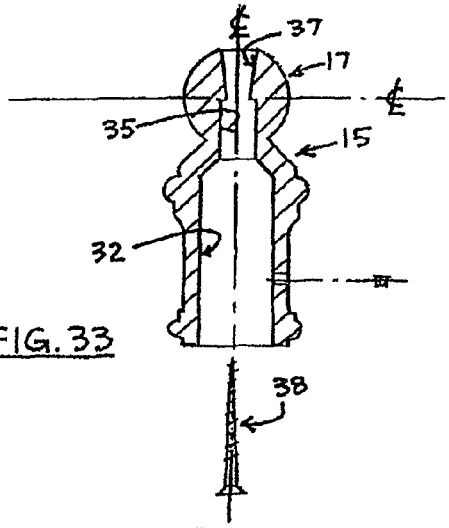
FIG. 33 is a section view of one form of a ball adapter.

FIG. 33 illustrates one of the preferred forms of the ball adapter 15 wherein there are three levels of interior cavities; a first cavity 32 for receiving a portion of a baluster, a second cavity 35 for passage of a fastening means 38 such as a screw, and a third cavity 37 for passage of the fastening means and to allow flexible mounting of the ball adapter and movement of the baluster about the center of the ball surface 17.

Figure 34:
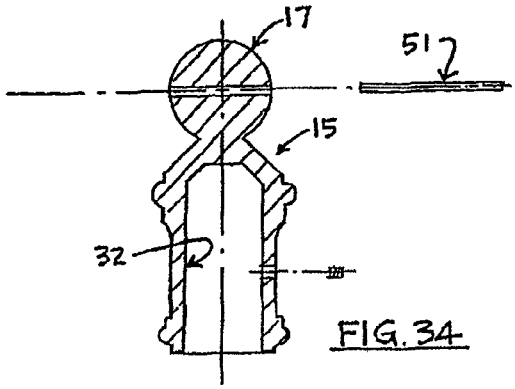
FIG. 34 is a section view of an alternative form of a ball adapter.

FIG. 34 illustrates another preferred form of the ball adapter invention wherein the flexible mounting of the ball adapter 15 is accomplished by mounting the ball adapter with a pin 51 passing through the center of the ball 17. The pin is then secured to a socket that is mounted on a rail system.

Figure 35:
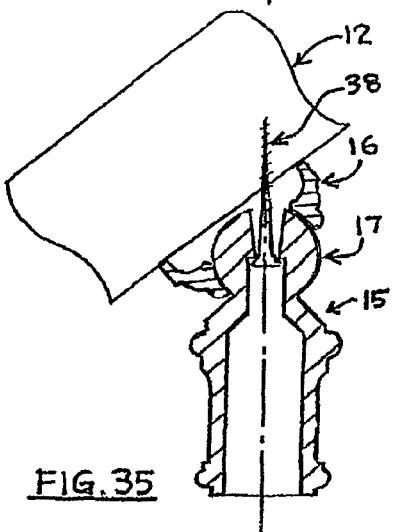
FIG. 35 is a partial section view of the installation of a ball adapter and a socket.

FIG. 35 illustrates the flexibility of the mounting of the ball adapter 15 as shown in FIG. 33 wherein the ball adapter 15 is used to attach the ball to a rail structure 12 with a socket 16 contacting the rail and screw 38 passing through the ball 17 and the pyramidal cavity 37 to the rail. The flexibility is provided by the movement of the ball adapter about the mounting within the socket 16 within the limits of the opening of the pyramidal cavity.

Figure 36:
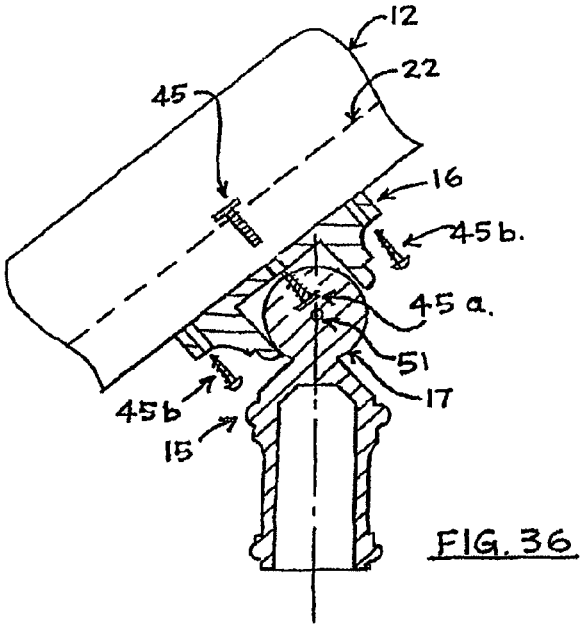
FIG. 36 is a partial section view of alternative forms of ball adapter and socket installations.

FIG. 36 illustrates another of the preferred embodiments of the present invention illustrating several attachment means for connecting the socket to the rail or fillet rail 12 and includes a screw 45 extending down from the rail, or a screw 45*a* extending upwardly through the socket base and into the face of the rail 12, or side screws 45*b* extending upwardly through flanges of the socket 16. In each of these attaching means the purpose is to attach the socket 16 to the rail 12. The interior of the socket is adapted to receive the ball surface 17 of the ball adapter in the socket 16. The mounting of the ball for its limited rotary movement is through a pin 51 extending through the transverse holes 49 in the socket (not shown) and the hole (not shown) through the center of ball 17. The purpose of this mounting is to provide limited rotary of the ball adapter about an axis perpendicular to the longitudinal axis of the rail 12.

Figure 37:
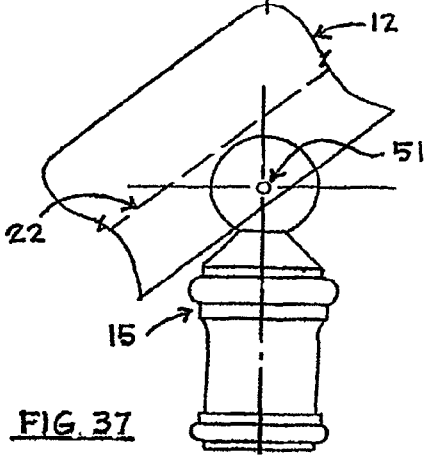
FIG. 37 is an illustration of the installation of a ball adapter without a socket.

FIG. 37 illustrates that the axis of rotation of the ball adapter at the pin 51 is within the cavity 48 in the interior of the socket 16 (or in the case of a pin support within the rail as shown in FIGS. 22 & 23) is not visible from the exterior of the mounting of the ball adapter to the rail. A finished mounting of balusters with the apparatus of the preferred embodiments as here illustrated would provide a finished appearance without blemishes.

Figure 38:
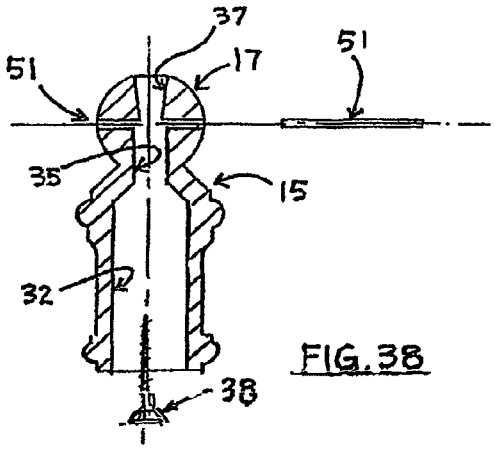
FIG. 38 is an illustration of two alternative forms of attaching a ball adapter to a socket.

FIG. 38 illustrates a ball adapter 15 with both the central mounting screw attachment means passing through the center of the ball 17 and an adaptation for central pivot pin 51 that would pass through the center of the ball 17 and provide for movement about the pin.

Figure 39:
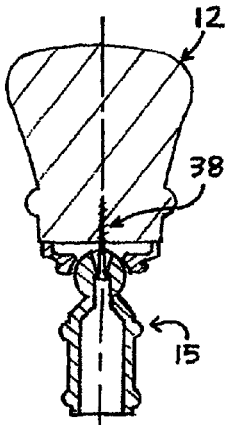
FIG. 39 is an illustration of the ball adapter and socket installed on a rail.
Figure 40:
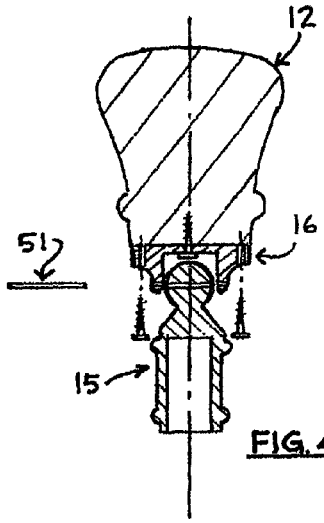
FIG. 40 is an illustration of a ball adapter and an alternative socket on a rail.
Figure 41:
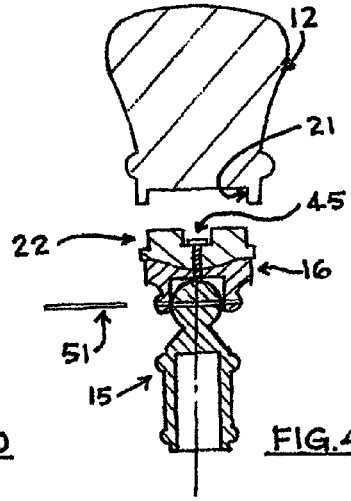
FIG. 41 is a section view of a ball adapter and socket installation with a rail having a plough and a fillet rail.

FIGS. 39, 40 and 41 illustrate the several attachments of a ball adapter to a rail 12. In FIG. 39 the attachment is either through a central screw attachment means of pin 51 each of which provides for limited movement of the ball adapter 15 with respect to the rail 12. FIG. 40 illustrates the attachment of the ball adapter 15 to the central cavity of socket 16 at pin 51 extending through the center of the ball 17; the socket is attached to the rail 12 by screws 45*b* (or the like) passing through a portion of the socket 16. FIG. 41 illustrates the attachment an assembly of the ball adapter 15 with a socket 16 attached to a fillet rail 22 by a screw 45 passing into the center of the top of the socket 16 and the entire assembly is maintained within a plough 21 of a rail 12.

Figure 42:
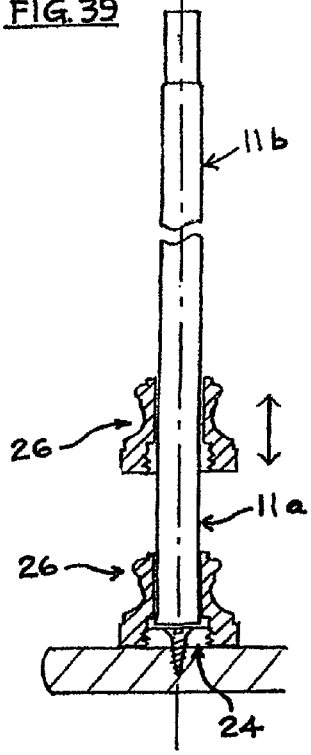
FIG. 42 is an illustration of the mounting of the end of baluster to a tread, balcony or landing.

FIG. 42 illustrates the axial sliding of a base connector 26 along the lower end of a baluster 11*a* and the connection to the base washer or adapter 24.

Figure 43:
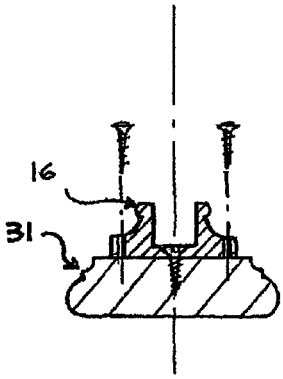
FIG. 43 is an illustration of a socket mounted to a shoe rail.

FIG. 43 illustrates the socket 21 attached to a base or shoe rail 31 (or a tread) as it could be adapted to receive a ball adapter 15 in the several mounting arrangements previously described.

Figure 44:
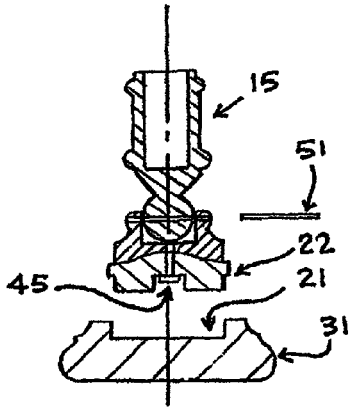
FIG. 44 is an illustration of a ball adapter and socket on a shoe rail with a plough.

FIG. 44 illustrates the attachment of a ball adapter to a base or shoe rail 31 (or tread) wherein the base rail includes a plough 21 to which a fillet rail 22 is connected. The assembly is intended to illustrate that the same elements can be used in the base and top attachment of a baluster to a stair or deck.

Figure 45:
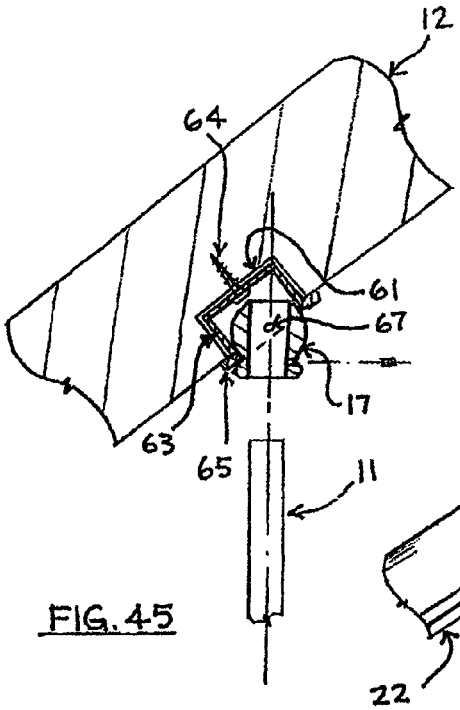
FIG. 45 is an illustration of a ball adapter in a cutout hole in a rail.

FIG. 45 shows an alternative form of the mounting system using a cutout in the undersurface of a rail 12. In this form, the cutout 61 has a cup shaped insert 63 that is attached by a screw 64 so as to lock within the cutout. The insert 63 has an outer ridge 65 with a transverse hole 66 (not shown) adapted to pass a pin 67. The ball 17 for this assembly has an interior transverse hole 68 (not shown) for receiving the pin 67 that is passed through the insert 63 to support the ball 17 for limited rotational movement with respect to the axis of the rail 12.

Figure 46:
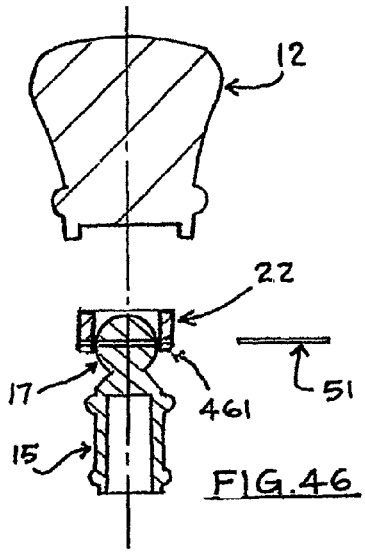
FIG. 46 is an illustration of a ball adapter attached to a fillet rail with a pin for installation in a rail with or without a plough.

FIG. 46 illustrates an alternative mounting for the ball adapter 15 within a fillet rail 22 that is adapted to mate with the plough 21 in a rail 12. The fillet rail 22 is constructed with an edge 461 that is large enough to permit a hole to pass through the edge to accommodate a pin 51. The ball 17 of the ball adapter 15 also has a hole (not shown) that passes through its center and is adapted to receive the partial pins 51. The ball adapter 15 is then supported for limited rotational movement about the pin 51 within the fillet rail 22.

Figure 47:
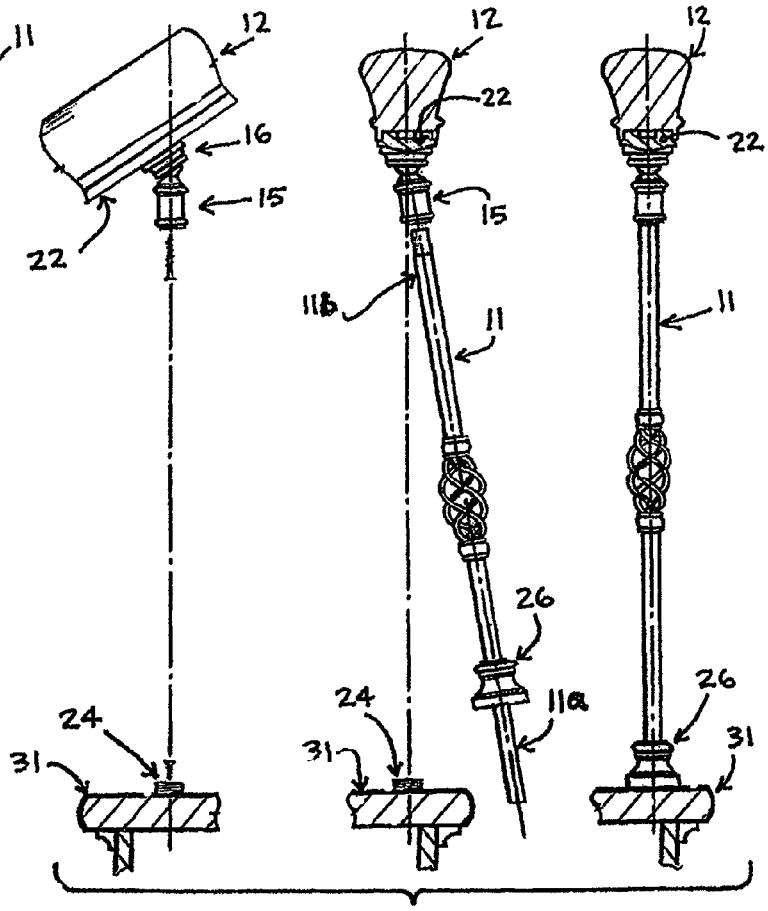
FIG. 47 is an illustration of the series of steps in installing a baluster in accord with one form of the present invention.

FIG. 47 is a three part illustration of the mounting of a baluster between a rail 21 and a base here shown as a tread 31 using a ball adapter 15 and socket 16. In the method shown here and with the apparatus shown, a baluster 11 first has its upper end 11*b* inserted into the interior cavity 32 of the ball adapter 15 with the ball adapter rotated about its pivotal connection to the rail 12 and/or fillet rail. An internally threaded connector 26 is slideably positioned on the lower end 11*a* of the baluster and the baluster is moved to be adjacent to the tread or base 31. A threaded base washer 24 is her shown attached to the base 31 directly below the position of the ball adapter 15 attachment to the rail 21. The upper end 11*b* of the baluster 11 is then raised into the inner cavity of the ball adapter a sufficient distance to permit the lower end 11*a* of the baluster 11 to be moved to a position directly above the threaded base washer 24 and the lower end 11*a* of the baluster is positioned on top of the washer 24. The connector is then threaded onto the washer 24 to lock the alignment of the baluster. A set screw 28 can then be set in the upper ball adapter and the lower connector to fix the baluster against rotational movement. All connections of the baluster to the upper rail and the lower rail have a finished appearance. The mounting of the baluster between the upper rail and the lower base has been accomplished using the apparatus and method of the present invention,.

While certain preferred embodiments of the invention have been specifically disclosed, it should be understood that the invention is not limited thereto as many variations will be readily apparent to those skilled in the art and the invention is to be given its broadest possible interpretation within the terms of the following claims.

I claim:

1. A baluster attachment apparatus for connecting a baluster along a surface of a stair in a desired orientation with respect to said surface, said surface of said stair including a rail, deck, tread, knee wall, balcony, landing or the like, said attachment apparatus comprising:

a) a ball adapter, b) an attachment socket including a tapered first opening shaped to engage an exterior of said ball adapter to provide a movable connection between said attachment socket and said ball adapter and a second opening terminating in a perimeter shoulder, c) said ball adapter comprising:

i) a spherical ball structure, said ball structure having a center, a diameter and a spherical perimeter at a ball end, and an open end for receiving a first end of said baluster at an end of the ball structure opposite said ball end, said open end including an interior cavity terminating below said ball end, said ball structure further including a passageway extending from said first interior cavity toward said center of said ball structure, the passageway having a diameter smaller than a diameter of said interior cavity for engagement with a head of a screw, wherein an extending pyramidal cavity extends from the passageway to the spherical perimeter at said ball end, ii) the screw passes through said interior cavity, said passageway and said extending pyramidal cavity within said ball structure, as well as said first and second openings of said attachment socket for directly attaching said ball end to said stair surface in a desired orientation with respect to said surface of said stair, without directly attaching said attachment socket to said stair surface which is held between said ball adapter and said stair, iii) said screw functions within said ball structure functioning for engaging said spherical perimeter of said ball adapter with said attachment socket to permit rotational and two dimensional movement of said ball end within said socket about the center of said spherical ball structure and for connecting said attachment socket to said surface of said stair, iv) said screw passes through said interior cavity, said passageway and said extending pyramidal cavity from the center of said spherical ball structure through said ball end and said socket and engages said surface of said stair to engage said attachment socket to said surface of said stair with said ball adapter at said desired orientation with respect to said surface of said stair, d) said attachment socket including an open end for movably receiving said spherical perimeter of said ball end of said spherical ball structure, and a mounting surface for engaging said socket to said surface of said stair, e) and structure in said ball adapter for attaching the first end of said baluster to said ball adapter in said desired orientation to said surface of said stair.

2. The apparatus of claim 1 wherein said interior cavity includes a first dimension for accommodating said first end of said baluster, said interior cavity providing for axial movement of said baluster within said interior cavity with respect to said spherical ball.

3. A baluster with the attachment apparatus of claim 1 at said first end of said baluster and mounting structure at an opposite second end of said baluster for mounting said baluster to a horizontal base of a deck, stair tread, balcony or landing, said mounting structure including:

a) an externally adapted base element attached to said horizontal base, b) a hollow base member adapted to be axially slideable along said baluster at said second end, one end of said hollow base member having an internal adaptation for mating with said externally adapted base element, whereby said attachment apparatus attaches said first end of said baluster to said surface of said stair rail and said mounting structure attaches said second end of said baluster to said horizontal base of a stair, deck, tread, balcony or landing by axially sliding said hollow base member along said baluster and mating said base member adaptation to said externally adapted base element.

4. The apparatus of claim 3 wherein said externally adapted base element is an externally threaded washer element fixed to said horizontal base of a stair, deck, tread, balcony or landing, and said adaptation of said hollow base member is an internally threaded adaptation.

5. The apparatus of claim 3 wherein said base element is hollow and said baluster is attached to the interior of said hollow base element.

6. A plurality of the attachment apparatuses of claim 1 attached to a fillet rail in longitudinally spaced alignment for assembly of balusters longitudinally along a stair, deck, tread, balcony or landing.

* * * * *